US006074252A

United States Patent [19]

Grieve

[11] Patent Number: 6,074,252

[45] Date of Patent: Jun. 13, 2000

[54] ELECTRICAL PLUG

[76] Inventor: John Grieve, 29 Dove Park, Chorleywood, Hertfordshire WD3 5NY, United Kingdom

[21] Appl. No.: 09/292,575

[22] Filed: Apr. 15, 1999

[51] Int. Cl.[7] ..... H01R 33/95; H01R 13/04

[52] U.S. Cl. ..... 439/622; 439/694

[58] Field of Search ..... 439/622, 621, 439/620, 893, 425, 695, 696, 694, 689, 456, 934

[56] References Cited

U.S. PATENT DOCUMENTS 4,500,746 2/1985 Meehan ..... 174/48

4,684,196 8/1987 Smith et al. ..... 439/411

5,004,432 4/1991 Tucker ..... 439/417

*Primary Examiner*—Lincoln Donovan

*Assistant Examiner*—Chandrika Prasad

[57] ABSTRACT

A electrical plug for easily connecting to the electrical wires of an electrical cord. The electrical plug includes a housing with a front face of the housing having a plurality of prongs extending therefrom. The housing has a plurality of elongate channels disposed therein. Each of the channels has a contact therein electrically connecting the respective channel to an associated prong. A fuse is disposed in the housing and is electrically connected between one of the contacts and its associated prong. The housing has a passage therein designed for extending therethrough an end of an electrical cord into the housing.

5 Claims, 3 Drawing Sheets

ELECTRICAL PLUG

BACKGROUND OF THE INVENTION

1. Field of the Invention

The present invention relates to electrical plugs and more particularly pertains to a new electrical plug for easily connecting to the electrical wires of an electrical cord.

2. Description of the Prior Art

The use of electrical plugs is known in the prior art. More specifically, electrical plugs heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,384,559; 2,636,097; U.S. Pat. No. Des. 292,700; U.S. Pat. Nos. 4,679,877; 4,841,332; and U.S. Pat. No. 2,640,125.

While these devices fulfill their respective, particular objectives and requirements, the aforementioned patents do not disclose a new electrical plug. The inventive device includes a housing with a front face of the housing having a plurality of prongs extending therefrom. The housing has a plurality of elongate channels disposed therein. Each of the channels has a contact therein electrically connecting the respective channel to an associated prong. A fuse is disposed in the housing and is electrically connected between one of the contacts and its associated prong. The housing has a passage therein designed for extending therethrough an end of an electrical cord into the housing.

In these respects, the electrical plug according to the present invention substantially departs from the conventional concepts and designs of the prior art, and in so doing provides an apparatus primarily developed for the purpose of easily connecting to the electrical wires of an electrical cord.

SUMMARY OF THE INVENTION

In view of the foregoing disadvantages inherent in the known types of electrical plugs now present in the prior art, the present invention provides a new electrical plug construction wherein the same can be utilized for easily connecting to the electrical wires of an electrical cord.

The general purpose of the present invention, which will be described subsequently in greater detail, is to provide a new electrical plug apparatus and method which has many of the advantages of the electrical plugs mentioned heretofore and many novel features that result in a new electrical plug which is not anticipated, rendered obvious, suggested, or even implied by any of the prior art electrical plugs, either alone or in any combination thereof.

To attain this, the present invention generally comprises a housing with a front face of the housing having a plurality of prongs extending therefrom. The housing has a plurality of elongate channels disposed therein. Each of the channels has a contact therein electrically connecting the respective channel to an associated prong. A fuse is disposed in the housing and is electrically connected between one of the contacts and its associated prong. The housing has a passage therein designed for extending therethrough an end of an electrical cord into the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new electrical plug apparatus and method which has many of the advantages of the electrical plugs mentioned heretofore and many novel features that result in a new electrical plug which is not anticipated, rendered obvious, suggested, or even implied by any of the prior art electrical plugs, either alone or in any combination thereof.

It is another object of the present invention to provide a new electrical plug which may be easily and efficiently manufactured and marketed.

It is a further object of the present invention to provide a new electrical plug which is of a durable and reliable construction.

An even further object of the present invention is to provide a new electrical plug which is susceptible of a low cost of manufacture with regard to both materials and labor, and which accordingly is then susceptible of low prices of sale to the consuming public, thereby making such electrical plug economically available to the buying public.

Still yet another object of the present invention is to provide a new electrical plug which provides in the apparatuses and methods of the prior art some of the advantages thereof, while simultaneously overcoming some of the disadvantages normally associated therewith.

Still another object of the present invention is to provide a new electrical plug for easily connecting to the electrical wires of an electrical cord.

Yet another object of the present invention is to provide a new electrical plug which includes a housing with a front face of the housing having a plurality of prongs extending therefrom. The housing has a plurality of elongate channels disposed therein. Each of the channels has a contact therein electrically connecting the respective channel to an associated prong. A fuse is disposed in the housing and is electrically connected between one of the contacts and its associated prong. The housing has a passage therein designed for extending therethrough an end of an electrical cord into the housing.

Still yet another object of the present invention is to provide a new electrical plug that includes a fuse electrically connected between the hot prong and the hot wire.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 through 6 thereof, a new electrical plug embodying the principles and concepts of the present invention will be described.

As best illustrated in FIGS. 1 through 6, the electrical plug generally comprises a housing with a front face of the housing having a plurality of prongs extending therefrom. The housing has a plurality of elongate channels disposed therein. Each of the channels has a contact therein electrically connecting the respective channel to an associated prong. A fuse is disposed in the housing and is electrically connected between one of the contacts and its associated prong. The housing has a passage therein designed for extending therethrough an end of an electrical cord into the housing.

Figure 1:
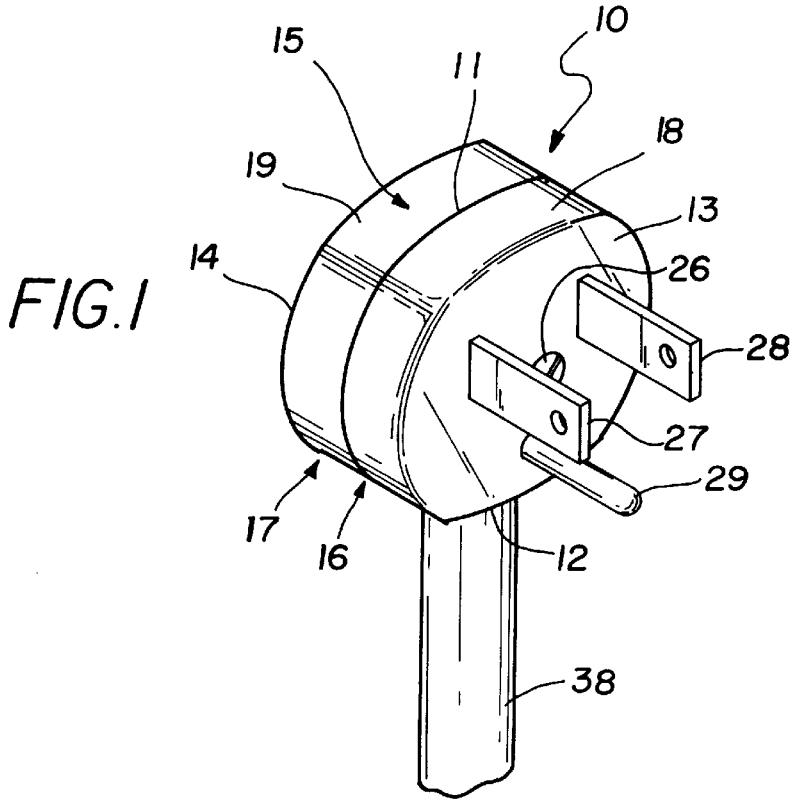
FIG. 1 is a schematic front perspective view of a new electrical plug according to the present invention.
Figure 2:
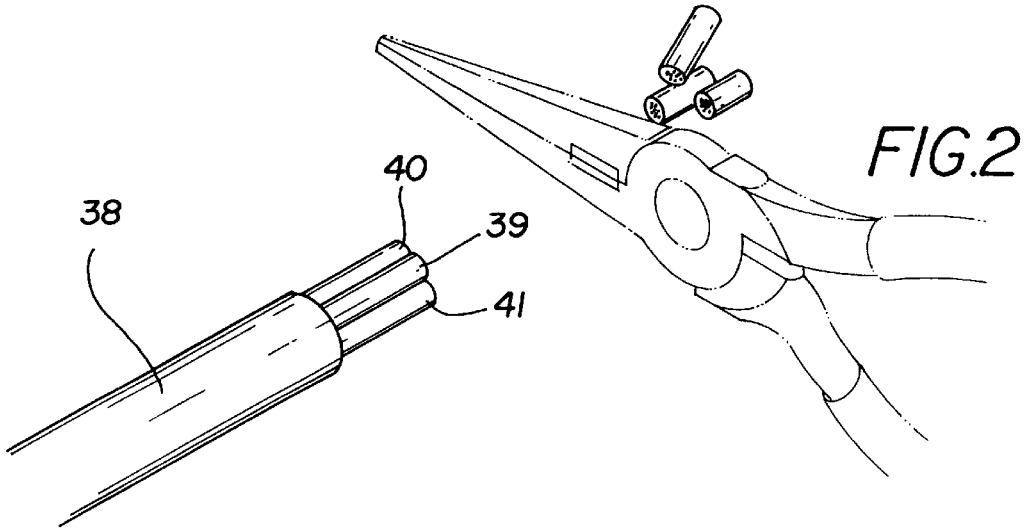
FIG. 2 is a schematic perspective view of an electrical conduit used with the present invention.
Figure 3:
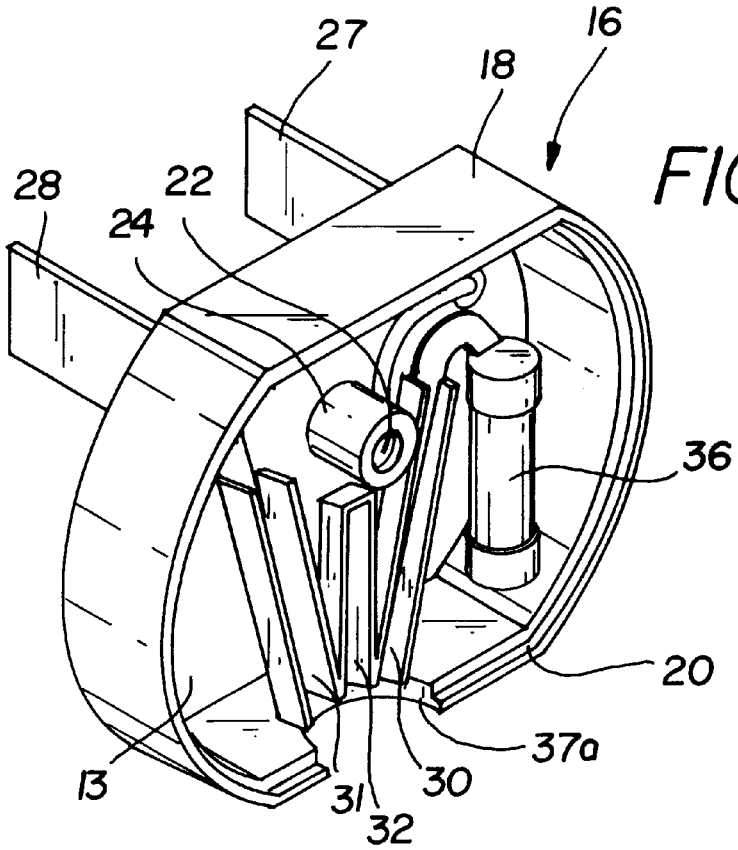
FIG. 3 is a schematic perspective view of the inside of the front portion of the housing.
Figure 4:
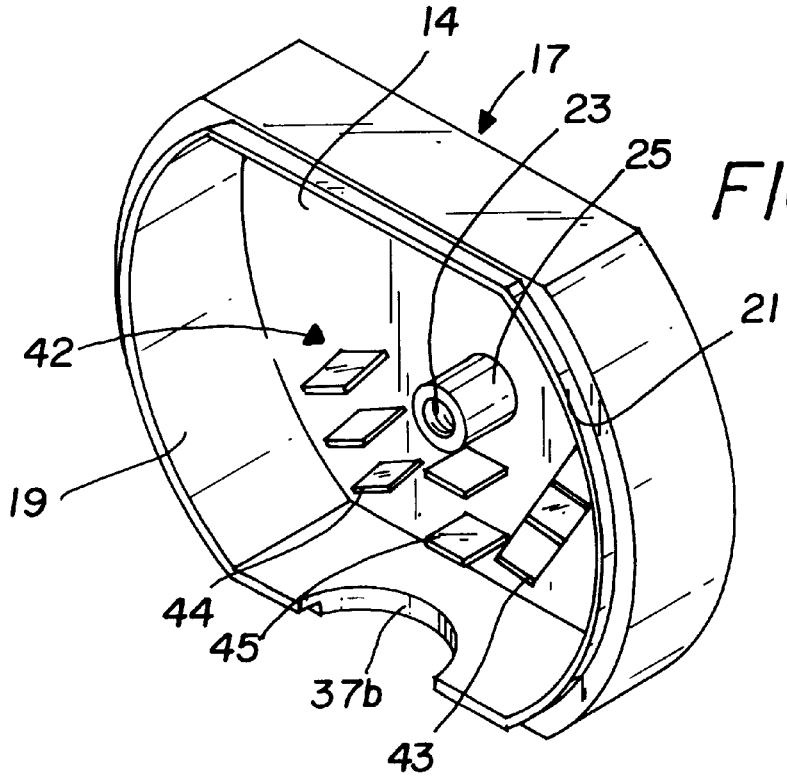
FIG. 4 is a schematic perspective view of the inside of the back portion of the housing.
Figure 5:
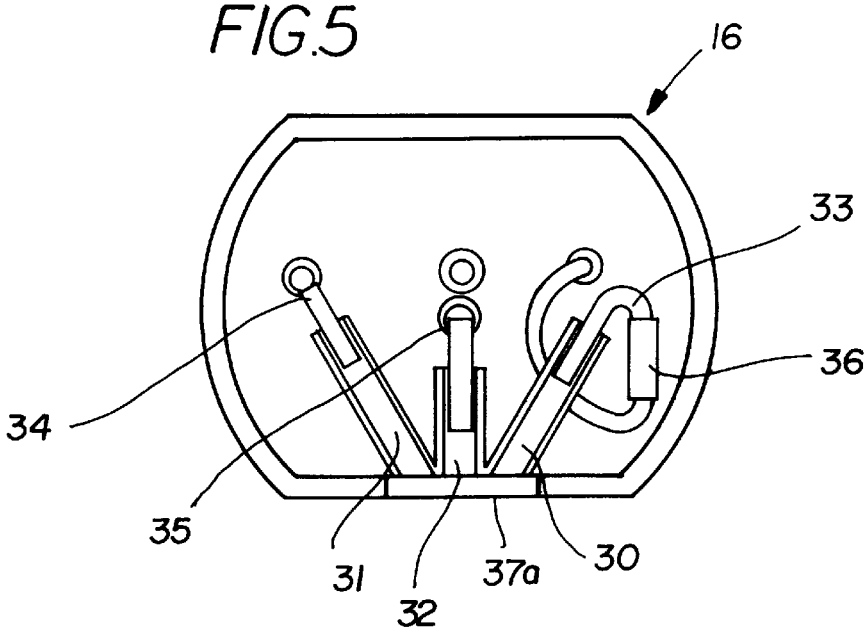
FIG. 5 is a schematic plan view of the inside of the front portion of the housing.
Figure 6:
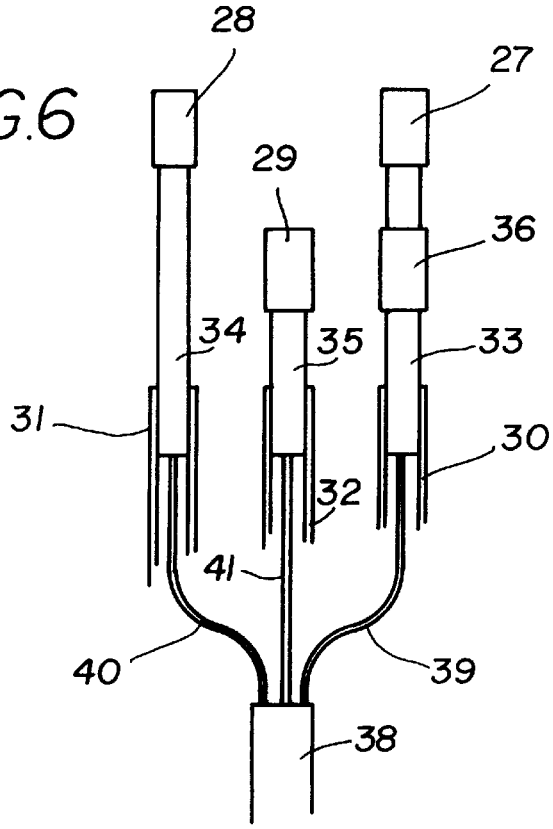
FIG. 6 is an electrical schematic view of the connection between the wires and the prongs via the channels and contacts.

In closer detail the electrical plug comprises a housing 10 having a top 11, a bottom 12, front and back faces 13,14, and a perimeter wall 15 between the front and back faces of the housing. The housing comprises separable front and back portions 16,17 detachably attached to one another. With reference to FIG. 3, the front portion 16 of the housing includes the front face of the housing and a front region 18 of the perimeter side wall adjacent the front face of the housing. With reference to FIG. 4, the back portion 17 of the housing includes the back face of the housing and a back region 19 of the perimeter side wall adjacent the back face of the housing.

The front and back regions of the perimeter side wall each terminate at an outer edge. The outer edges of the front and back regions of the perimeter side wall abut one another when the front and back portions of the housing are attached together. The outer edge of the front region preferably has an elongate groove 20 therealong while the outer edge of the back region preferably has an elongate ridge 21 therealong. The ridge of the outer edge of the back region is extended into the groove of the outer edge of the front region when the front and back portions are attached together to help hold the front and back portions securely together when attached.

The front and back faces of the housing each have a threaded bore 22,23. The threaded bore of the front face has an open end through the front face of the housing while the threaded bore of back face of the housing preferably has a closed end at the back face of the housing. Each of the threaded bores preferably has an extent 24,25 inwardly extending into the housing. The threaded bores of the front and back faces are coaxially aligned with one another and a threaded fastener 26 is threadably inserted through the threaded bore of the front face and into the threaded bore of the back face to attach the front and back portions of the housing together.

The front face of the housing has a plurality of prongs 27,28,29 outwardly extending therefrom. Preferably, the plurality of prongs comprises three prongs. Each of the prongs is designed for insertion into a corresponding socket of an electrical receptacle.

With reference to FIG. 3, the front portion of the housing has a plurality of elongate channels 30,31,32 disposed in the interior of the housing. Each of the channels has an electrical contact 33,34,35 therein. The contact 33 of a first of the channels 30 is electrically connected to a first of the prongs 27 (the hot prong). The contact 34 of a second of the channels 31 is electrically connected to a second of the prongs 28 (the neutral prong). The contact 35 of a third of the channels 32 is electrically connected to a third of the prongs 29 (the ground prong).

In use, the first prong is designed for insertion into the hot socket of an electrical receptacle, the second prong is designed for insertion into the neutral socket of an electrical receptacle, and the third prong is designed for insertion into the ground socket of an electrical receptacle. A fuse 36 is preferably disposed in the housing and electrically connected between the first contact and the first prong for breaking the connection between the first contact and first prong if more than a predetermined amount of current is drawn therethrough, the fuse is detachably mounted to the front portion of the housing.

As illustrated in FIG. 3, each of the channels of the front portion has an end positioned at the bottom of the housing with each of the channels extending from the bottom of the housing towards the top of the housing. The perimeter side wall of the housing has a generally circular passage therethrough located at the bottom of the housing and adjacent the ends of the channels. The front and back regions of the perimeter side wall each include a generally semi-circular portion 37*a*,37*b* of an outer periphery of the passage of the perimeter side wall.

In use, the passage of the perimeter side wall is designed for extending an end of an electrical cord 38 therethrough into the housing. The first channel is designed for receiving therein a first wire 39 (the hot wire) extending from the end of the electrical cord extended into the housing via the passage. The second channel is designed for receiving therein a second wire 40 (the neutral wire) extending from the end of the electrical cord extended into the housing via the passage. The third channel is designed for receiving therein a third wire 41 (the ground wire) extending from the end of the electrical cord extended into the housing via the passage. The contact of each channel is in electrical contact with (i.e., abutment with a conductive part of) the wire of the electrical cord received by the respective channel to electrically connect each wire to the associated prong.

Preferably, as best illustrated in FIG. 4, the back face of the housing has a plurality of spaced apart tabs 42 extending into the housing, the tabs are arranged into three rows 43,44,45. The tabs of a first of the rows 44 are extended into the first channel. The tabs of a second of the rows 43 are extended into the second channel. The tabs of a third of the rows 45 are extended into the third channel. In use, the tabs are designed for holding the wire received by the associated channel against the contact of the associated channel when the front and back portions of the housing are attached together so that the wires are firmly held against the contacts to maintain a secure electrically connection to the prongs.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An electrical plug structure, comprising:

a housing having front and back faces;

said front face of said housing having a plurality of prongs extending therefrom;

said housing having a plurality of elongate channels disposed therein;

each of said channels having a contact therein;

said contact of a first of said channels being electrically connected to a first of said prongs, said contact of a second of said channels being electrically connected to a second of said prongs;

a fuse being disposed in said housing and being electrically connected between said first contact and said first prong, for breaking the connection between said first contact and said first prong if more than a predetermined amount of current is drawn therethrough, said fuse being detachably mounted to said front portion of said housing;

said housing having a passage therein adapted for extending therethrough an end of an electrical cord into said housing;

said first channel being adapted for receiving therein a first wire of the electrical cord extended into said housing via said passage;

said second channel being adapted for receiving therein a second wire of the electrical cord extended into said housing via said passage;

wherein each of said channels has a pair of channel walls adapted for cradling the wire of the electrical cord therebetween for preventing inadvertent contact between the wires of the electrical cord; and wherein each of said channels has an end positioned at said bottom of said housing, said first and second channels extending at an angle from said bottom of said housing such that the wires of the electrical cord are bent at slight angles from the electrical cord to prevent breakage of the wire due to extreme bending.

2. The electrical plug structure of claim 1, wherein said housing comprises separable front and back portions detachably attached to one another.

3. The electrical plug structure of claim 2, wherein said front and back portions of said housing each have a threaded bore, wherein a threaded fastener is threadably inserted through said threaded bore of said front portion and into said threaded bore of said back portion to attach said front and back portions of said housing together.

4. The electrical plug structure of claim 1, wherein said housing has a plurality of spaced apart tabs extending therein, said tabs being arranged into a plurality of rows, said tabs of a first of said rows being extended into said first channel, said tabs of a second of said rows being extended into said second channel.

5. An electrical plug structure, comprising:

a housing having a top, a bottom, front and back faces, and a perimeter wall between said front and back faces of said housing;

said housing comprising separable front and back portions detachably attached to one another;

said front portion of said housing including said front face of said housing and a front region of said perimeter side wall adjacent said front face of said housing;

said back portion of said housing including said back face of said housing and a back region of said perimeter side wall adjacent said back face of said housing;

said front and back regions of said perimeter side wall each terminating at an outer edge, said outer edges of said front and back regions of said perimeter side wall abutting one another when said front and back portions of said housing are attached together;

said outer edge of said front region having an elongate groove therealong, said outer edge of said back region having an elongate ridge therealong, said ridge of said outer edge of said back region being extended into said groove of said outer edge of said front region when said front and back portions are attached together;

said front and back faces of said housing each having a threaded bore, said threaded bore of said front face having an open end through said front face of said housing, said threaded bore of back face of said housing having a closed end at said back face of said housing;

a threaded fastener being threadably inserted through said threaded bore of said front face and into said threaded bore of said back face to attach said front and back portions of said housing together;

said front face of said housing having a plurality of prongs outwardly extending therefrom, wherein said plurality of prongs comprises three prongs, each of said prongs being adapted for insertion into a corresponding socket of an electrical receptacle;

said front portion of said housing having a plurality of elongate channels disposed in the interior of said housing;

each of said channels having a contact therein;

said contact of a first of said channels being electrically connected to a first of said prongs, said contact of a second of said channels being electrically connected to a second of said prongs, said contact of a third of said channels being electrically connected to a third of said prongs;

said first prong being adapted for insertion into the hot socket of an electrical receptacle, said second prong being adapted for insertion into the neutral socket of an electrical receptacle, said third prong being adapted for insertion into the ground socket of an electrical receptacle;

a fuse being disposed in said housing and being electrically connected between said first contact and said first prongs for breaking the connection between said first contact and said first prong if more than a predetermined amount of current is drawn therethrough, said fuse being detachably mounted to said front portion of said housing;

each of said channels of said front portion being extended from said bottom of said housing towards said top of said housing;

said perimeter side wall of said housing having a passage therethrough located at said bottom of said housing and adjacent said channels;

said front and back regions of said perimeter side wall each including a portion of an outer periphery of said passage of said perimeter side wall;

said passage of said perimeter side wall being adapted for extending an end of an electrical cord therethrough into said housing;

said first channel being adapted for receiving therein a first wire of the electrical cord extended into said housing via said passage;

said second channel being adapted for receiving therein a second wire of the electrical cord extended into said housing via said passage;

said third channel being adapted for receiving therein a third wire of the electrical cord extended into said housing via said passage;

wherein each of said channels has a pair of channel walls adapted for cradling the wire of the electrical cord therebetween for preventing inadvertent contact between the wires of the electrical cord;

wherein each of said channels has an end positioned at said bottom of said housing, said first and second channels extending at an angle from said bottom of said housing such that the wires of the electrical cord are bent at slight angles from the electrical cord to prevent breakage of the wire due to extreme bending;

said contact of each channel being adapted for being in electrical contact with the wire of the electrical cord received by the respective channel to electrically connect each wire to the associated prong; and said back face of said housing having a plurality of spaced apart tabs extending into said housing, said tabs being arranged into three rows, said tabs of a first of said rows being extended into said first channel, said tabs of a second of said rows being extended into said second channel, said tabs of a third of said rows being extended into said third channel, said tabs being adapted for holding the wire received by the associated channel against the contact of the associated channel when said front and back portions of said housing are attached together so that the wires are firmly held against said contacts to maintain a secure electrically connection to said prongs.

* * * * *